US008014551B2

(12) United States Patent
Iwano et al.

(10) Patent No.: US 8,014,551 B2
(45) Date of Patent: Sep. 6, 2011

(54) BEHIND-THE-EAR HEARING AID WHOSE MICROPHONE IS SET IN AN ENTRANCE OF EAR CANAL

(75) Inventors: Kenji Iwano, Kanagawa (JP); Hiroshi Kondo, Kanagawa (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/636,511

(22) Filed: Dec. 11, 2009

(65) Prior Publication Data

US 2010/0092016 A1 Apr. 15, 2010

Related U.S. Application Data

(63) Continuation of application No. PCT/JP2008/003757, filed on Dec. 12, 2008.

(30) Foreign Application Priority Data

May 27, 2008 (JP) ..... 2008-138198

(51) Int. Cl.
*H04R 25/00* (2006.01)

(52) U.S. Cl. ..... 381/330; 381/313

(58) Field of Classification Search ..... 381/330
See application file for complete search history.

(56) References Cited

U.S. PATENT DOCUMENTS 5,606,621 A 2/1997 Reiter et al.
5,712,917 A 1/1998 Offutt
5,814,095 A 9/1998 Muller et al.
5,920,635 A 7/1999 Lenz
5,987,146 A * 11/1999 Pluvinage et al. ..... 381/330
6,181,801 B1 1/2001 Puthuff et al.
6,275,596 B1 8/2001 Fretz et al.

(Continued)

FOREIGN PATENT DOCUMENTS

DE 103 57 800 5/2005

(Continued)

OTHER PUBLICATIONS

GB Office Action for corresponding application No. GB0921504.7, dated Jan. 20, 2010.

(Continued)

*Primary Examiner* — Brian Ensey
(74) *Attorney, Agent, or Firm* — Panasonic Patent Center; Dhiren Odedra; Kerry Culpepper

(57) ABSTRACT

There is provided a behind-the-ear hearing aid that makes it easy for a hearing aid wearer to estimate a position of a sound source with respect to a front-back direction and that enables an increase in aesthetic property when the hearing aid is worn. A behind-the-ear hearing aid of the present invention is used while fitted to an ear of a human body, and includes at least a microphone 101 which collects ambient sound, thereby generating an input signal and signal processing unit 102 that generates an output signal from the input signal. The hearing aid also has a behind-the-ear portion 110 that can be fitted to the ear and a receiver 103 that reproduces output sound from the output signal. When the behind-the-ear portion 110 is fitted to the ear, the microphone 101 is arranged in an entrance of an ear canal that lies in the extension of an ear canal 220 and that is disposed closer to an eardrum than to a plane that is defined by a helix 901, a tragus 902, and an earlobe 903.

8 Claims, 8 Drawing Sheets

U.S. PATENT DOCUMENTS

| | | | | |
|---|---|---|---|---|
| 6,714,654 | B2 * | 3/2004 | Lichtblau | 381/317 |
| 7,133,529 | B2 | 11/2006 | Ura | |
| 7,477,756 | B2 | 1/2009 | Wickstrom et al. | |
| 7,574,012 | B2 | 8/2009 | Eggers et al. | |
| 2003/0147544 | A1 | 8/2003 | Lichtblau | |
| 2005/0147266 | A1 | 7/2005 | Eggers et al. | |
| 2005/0157895 | A1 | 7/2005 | Lichtblau | |
| 2007/0076913 | A1 * | 4/2007 | Schanz | 381/381 |
| 2007/0217642 | A1 | 9/2007 | Wickstrom et al. | |
| 2008/0095390 | A1 | 4/2008 | Gebert et al. | |
| 2008/0107292 | A1 | 5/2008 | Kornagel | |

FOREIGN PATENT DOCUMENTS

| | | | |
|---|---|---|---|
| DE | 10 2004 044 318 | | 11/2005 |
| JP | 52-022403 | A | 2/1977 |
| JP | 04-152000 | | 5/1992 |
| JP | 10-056697 | | 2/1998 |
| JP | 10-56698 | A | 2/1998 |
| JP | 10-098797 | A | 4/1998 |
| JP | 10-504152 | A | 4/1998 |
| JP | 2003-32780 | | 1/2003 |
| JP | 2004-229179 | A | 8/2004 |
| JP | 3807750 | B2 | 5/2006 |
| JP | 3811731 | B2 | 8/2006 |
| JP | 2006-339911 | A | 12/2006 |
| JP | 2008-042310 | | 2/2008 |
| JP | 2008-104183 | | 5/2008 |
| WO | 03/067927 | | 8/2003 |
| WO | 2005/076768 | | 8/2005 |
| WO | 20071100336 | | 9/2007 |
| WO | 2009/123561 | | 10/2009 |

OTHER PUBLICATIONS

JPO Notice of Allowance (Trial Decision), dated Jul. 14, 2009, for JPO Application No. 2008-315849.

JPO Office Action (Decision of Refusal), dated Mar. 20, 2009, for JPO Application No. 2008-315849.

International Search Report of PCT Application No. PCT/JP2008/003757 dated Jun. 15, 2009.

Mayr, J. "Verdrillte Leiter verhindern elektrische and magnetische Felder". ("twisted wires prevent electric and magnetic fields") Source: Internet; Aug. 16, 2000, pp. 1-7.

German Office Action with English translation for application No. 11 2008 002 187.2, dated Oct. 28, 2010.

* cited by examiner

BEHIND-THE-EAR HEARING AID WHOSE MICROPHONE IS SET IN AN ENTRANCE OF EAR CANAL

CROSS-REFERENCE TO RELATED APPLICATIONS

This is a Continuation Application of PCT/JP2008/003757, filed on Dec. 12, 2008, which claims priority under 35 U.S.C. Section 119(a) to Japanese Patent Application No. 2008-138198 filed in Japan on May 27, 2008, the entire contents of which are incorporated herein by reference.

TECHNICAL FIELD

The present invention relates to a behind-the-ear hearing aid whose microphone is set in an entrance of an ear canal.

BACKGROUND ART

As related hearing aids, the one is the behind-the-ear (BTE) hearing aids and the other is the in-the-ear (ITE) hearing aid. The ITE hearing aid includes a completely-in-the-canal hearing aid, a concha-type hearing aid and a canal-type hearing aid. Recently hearing aid users tend to prefer a BTE hearing aid to an ITE type, because the BTE hearing aid is compact and unobtrusive when the user put it on a behind a pinna.

Some example, related-art behind-the-ear hearing aids have two constituent elements. The two constituent elements are a behind-the-ear (Behind The Ear: BTE) section and a completely-in-the-canal (Completely In the Canal: CIC) section. The BTE is equipped with a microphone, a battery, and signal processing unit; and a receiver is provided in an ear canal. Hitherto, a sound has been transmitted from a hearing aid main unit to an eardrum by way of an acoustic guide tube. The hearing aid yields an advantage of the ability to transmit sounds in wide frequency bands directly to an eardrum by way of placing a receiver in an ear canal (see; for instance, Patent Document 1). The receiver to be placed in the ear canal is referred to as a receiver in a canal (Receiver in Canal: RIC).

Another behind-the-ear hearing aid enables easy and specific adjustment for individual differences, such as the shape and size of a pinna of a hearing aid wearer. As shown in FIG. 8, the hearing aid is made up of an ear fitting 800 to be disposed in a dent in a pinna and a behind-the-ear portion 810. The ear fitting 800 has a microphone 801 and a receiver 803, and the behind-the-ear portion 810 has a signal processing section 802 and a power source. In this hearing aid, the length of the ear fitting 800 is adjustable in an extensible manner with respect to the behind-the-ear portion 810, and an angle of the ear fitting is adjustable in a rotatable manner (see; for instance, Patent Document 2).

RELATED ART REFERENCES

Patent Documents

Patent Document 1: Japanese Patent No. 3811731
Patent Document 2: JP-A-10-56698

SUMMARY OF THE INVENTION

Technical Problem

Incidentally, since a person has two ears, a time lag arises in the arrival of a sound at the right and left ears from a sound source when the sound source is disposed at any position in a horizontal direction other than just in front of or behind the person. The time lag is called an interaural time difference (ITD) and utilized for estimating the horizontal position of the sound source. Further, since distances from the sound source to both ears are different from each other, a difference arises in arrival sound pressure as well. The difference is called an interaural level difference (ILD) and likewise utilized for estimating the position of the sound source.

When the sound source locates in a vertical direction, such as front of, behind of, and directly above the person, only a nominal difference originated from asymmetry of the head exists in sounds entering both ears, and both the ITD and the ILD hardly arise. In this case, in order to estimate the position of the sound source, the person estimates the direction of the sound source by differences in frequency characteristic originated from actions of such as diffraction and reflection caused by the head, the shoulders, and the pinnas. A characteristic of a transmission channel from the sound source to drum membranes of both ears is referred to as a head related transfer function (HRTF).

In many related behind-the-ear-type hearing aids, a microphone is disposed at an upper area of a hearing aid main unit; namely, an upper position on a pinna. Namely, sound picked up by a microphone of the behind-the-ear-type hearing aid does not affect any changes in frequency characteristic originated from the shape of the pinna. Therefore, under the present situations, a person wearing a behind-the-ear-type hearing aid has difficulty in estimating the location of the sound source in front and back directions.

Even in a BTE-type hearing aid in which an ear fitting having a microphone is placed in a dent of a ear as described in the Patent Document 2, a detection hole for a microphone is provided on a side of the ear fitting opposite to the drum membrane, and hence a sound cannot sufficiently experience a change in frequency characteristic attributable to the shape of a pinna.

As related completely-in-the-canal-type hearing aids which are small and exhibit a much superior aesthetic property, there have been CIC hearing aids. However, the CIC hearing aid must have in an ear canal all constituent elements pertaining to the hearing aid, such as a microphone, a speaker, signal processing unit, and a battery. In order to place the constituent elements of the hearing aid in a limited internal space of the ear canal, the battery is limited to a compact battery having a small capacity. Since the user of the hearing aid must frequently replace a battery, it is not necessary the case that the hearing aid provides high convenience. Further, as the completely-in-the-canal-type hearing aid, there has been a custom-designed hearing aid that is designed so as to fit to the form of an ear of a hearing aid wearer. However, it is necessary to obtain an ear mold of the hearing aid wearer and manufacture a hearing aid shell in agreement with the ear mold. As compared with a ready-made hearing aid, the custom-designed hearing aid is expensive.

The present invention has been conceived in light of the above circumstance and aims at providing a behind-the-ear hearing aid that makes it easy for a wearer to estimate the location of a sound source in front and back directions and that can exhibit a superior aesthetic property when worn.

Solution to the Problem

A behind-the-ear hearing aid of the present invention is a behind-the-ear hearing aid used while worn on an ear of a human body, including a microphone collecting an ambient sound and generating an input signal; a main unit to be fitted to the ear and including at least signal processing unit for generating an output signal based on the input signal; and a receiver reproducing output sound based on the output signal. When the main unit is fitted to the ear, the microphone is disposed in an entrance of an ear canal that lies in an extension of the ear canal and that is disposed closer to an eardrum than to a plane defined by a helix, a tragus, and an earlobe.

According to the configuration, since a change in the frequency characteristic of the pinna is reflected on the input sound, it is easy to estimate the direction of the sound source in front and back directions. Further, the main unit of the hearing aid is disposed at an upper portion of the pinna and a position behind the pinna, whereby a hearing aid exhibiting a superior aesthetic property can be provided.

Moreover, in the behind-the-ear hearing aid of the present invention, when the main unit is fitted to the ear, the receiver is disposed in the ear canal.

According to the configuration, the sound output from the hearing aid is directly transmitted to the drum surface of the hearing aid wearer. Accordingly, a hearing aid which has a wide range frequency characteristic can be provided.

Further, in the behind-the-ear hearing aid of the present invention, a signal line connected to the microphone and the signal processing unit is a twisted pair wire.

According to the configuration, the additive noise in a transmission line between the microphone disposed in the entrance of the ear canal and the main unit of the hearing aid disposed on the upper portion of the pinna is diminished, so that a signal-to-noise ratio (hereinafter abbreviated as an "SN ratio") of the input audio signal collected by the microphone can be improved.

In the behind-the-ear hearing aid of the present invention, a signal line connected to the microphone and the signal processing unit is a shielded wire.

According to the configuration, the additive noise in a transmission line between the microphone disposed in the entrance of the ear canal and the main unit of the hearing aid disposed on the upper portion of the pinna is diminished, so that the SN ratio of the input audio signal collected by the microphone can be improved.

The behind-the-ear hearing aid of the present invention further includes at least one projection projecting from a signal line connected to the microphone and the signal processing unit.

According to the configuration, the microphone can be stably held in the entrance of the ear canal that is the center of the pinna. It is possible to reduce an impact sound stemming from the microphone contacting the pinna as a result of movement of the head of the hearing aid wearer.

The behind-the-ear hearing aid of the present invention further includes a soundproof material interposed between the microphone and the receiver when the main unit is fitted to the ear.

According to the configuration, it is possible to reduce the probability of occurrence of a howling phenomenon in which the sound output from the receiver becomes the input sound for the microphone, to thus form a feedback circuit.

In the behind-the-ear hearing aid of the present invention, the microphone is an MEMS microphone.

According to the configuration, a microphone disposed in the entrance of the ear canal can be miniaturized and thus render the microphone unobtrusive.

The behind-the-ear hearing aid of the present invention further includes the microphone which collects an ambient sound and generates a first input signal; an amplifier which amplifies the first input signal and generates a second input signal; and a signal processing unit which generates an output signal based on the second input signal.

According to the configuration, the signal of the microphone can be amplified in order to lessen influence of a voltage drop due to extension of the signal line of the microphone and influence of the additive noise due to electromagnetic induction in a microphone signal line caused by a receiver signal line.

In the behind-the-ear hearing aid of the present invention, a plurality of the microphones are provided; and at least one of the microphones is disposed in an entrance of the ear canal when the main unit is fitted to the ear.

According to the configuration, since a plurality of microphones are utilized, the signal processing unit performs directivity synthesis processing for enhancing an input audio signal in the front direction of the face; and suppresses a howling phenomenon which is heard as for instance grating a beep sound so as to provide an output sound which is easy to hear for the hearing aid wearer.

In the behind-the-ear hearing aid of the present invention, at least one of the microphones is disposed in a rear of a pinna when the main unit is fitted to the ear.

According to the configuration, signal processing utilizing the input audio signals from the microphones separately disposed in the entrance of the ear canal and at the rear of the pinna is possible. The signal processing unit can easily perform detection of the howling and suppression of the noise with high accuracy.

Further, in the behind-the-ear hearing aid of the present invention, the signal processing unit compares intensity of the input signal from the microphone disposed in the entrance of the ear canal with intensity of the input signal from the microphone disposed in the rear of the pinna, and judges howling based on the result of comparison.

According to the configuration, it is easily judged whether howling occurs or not by utilizing the fact that the probability of occurrence of howling in the line between the microphone disposed at the rear of the pinna and receiver is low as compared with that in the line between the microphone disposed in the entrance of the ear canal and the receiver.

In the behind-the-ear hearing aid of the present invention, the signal processing unit corrects frequency characteristics of the input signals based on positions where the microphones are disposed.

According to the configuration, a difference in frequency characteristic due to a difference in transfer function is corrected through signal processing utilizing the input audio signals from the microphones separately disposed in the entrance of the ear canal and at the rear of the pinna, so that the output sound which the hearing aid wearer easily catches can be provided.

In the behind-the-ear hearing aid of the present invention, the signal processing unit generates the output signal having directivity toward a predetermined direction based on the input signals from the plurality of microphones.

According to the configuration, in the directivity synthesis process utilizing the input audio signals coming from the microphones individually disposed in the entrance of the ear canal and the rear of the pinna, it is possible to provide the output sound having directivity as if a sound coming from the front of the hearing aid wearer is enhanced even in conversation among a plurality of persons. For instance, the sensitivity for the sound from the major noise source direction can be made as close to zero as possible, and directivity for maintaining sensitivity to the sound in the direction of the front of the face high can be possible.

Advantage of the Invention

The present invention provides a behind-the-ear hearing aid in which a microphone is disposed in the entrance of an ear canal, thereby makes it possible to handle the sound coming from the sound source as input sound on which a frequency characteristic of the pinna is reflected. As a consequence, there can be provided a behind-the-ear hearing aid that makes it easy for a hearing aid wearer to estimate the position of a sound source in a vertical direction as well as in a horizontal direction; particularly, in a front-back direction.

DESCRIPTION OF EMBODIMENTS

Behind-the-ear hearing aids of embodiments of the present invention will be described by reference to the drawings.

Figure 9:
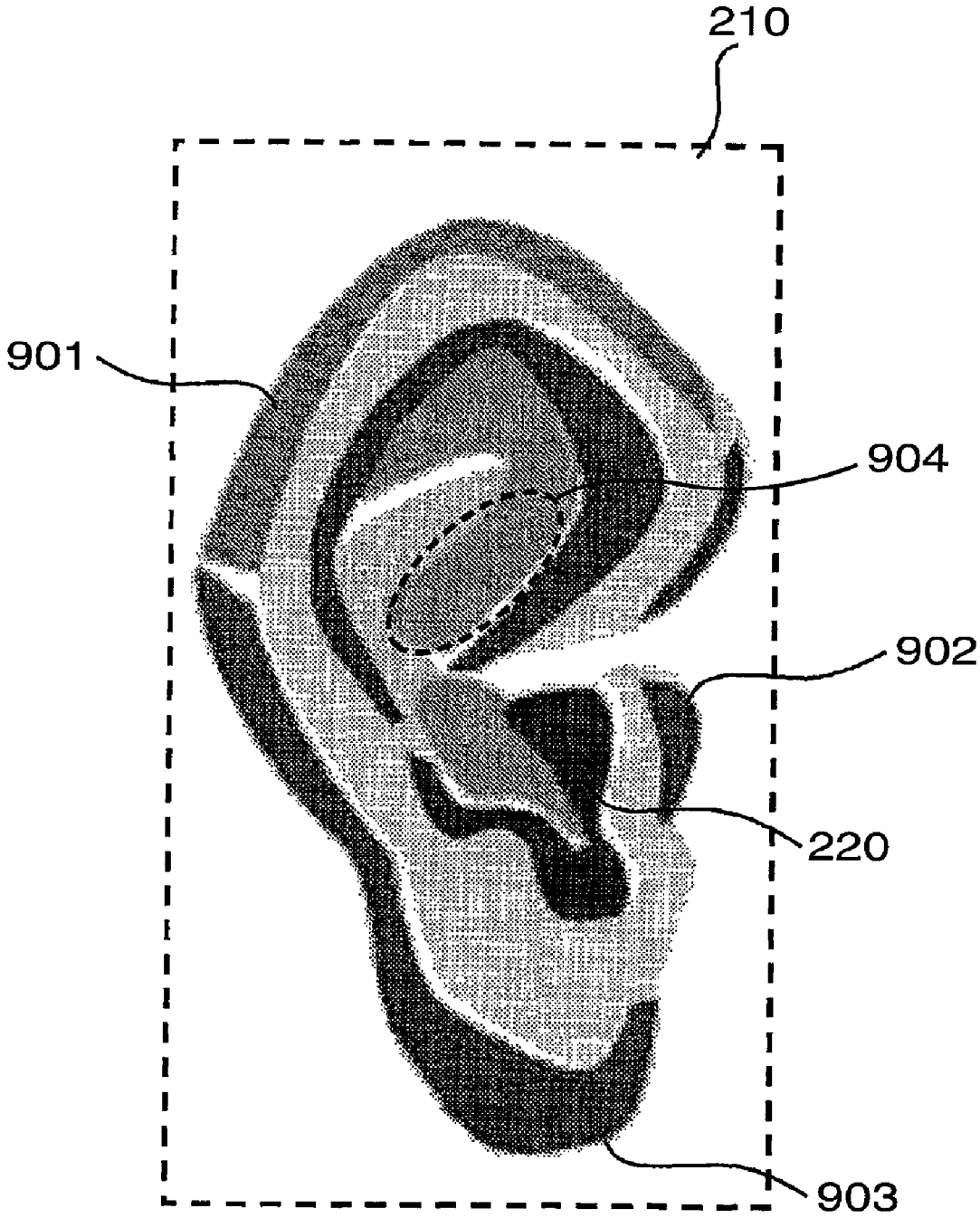
FIG. 9 It is a front view of an example pinna of a human body.

First, a portion of the hearing aid that is visible from the outside of an ear is briefly described by reference to FIG. 9. FIG. 9 is a front view of an example pinna. A pinna 210 is an outer peripheral portion of an auricle, is positioned on either side of the head, and is a shell-like projection surrounding an ear canal 220. A helix 901 is a soft area of the outer peripheral portion of the pinna 210 opposing a tragus 902. The tragus 902 is a prominence located at the entrance of the ear canal 220. The ear canal 220 is a substantially-S-shaped tube extending from the entrance of the ear canal to an eardrum. An earlobe 903 is a lobule and refers to a soft area hanging down from the ear. A concha is a dent located at the entrance of the ear canal 220.

First Embodiment

Figure 1:
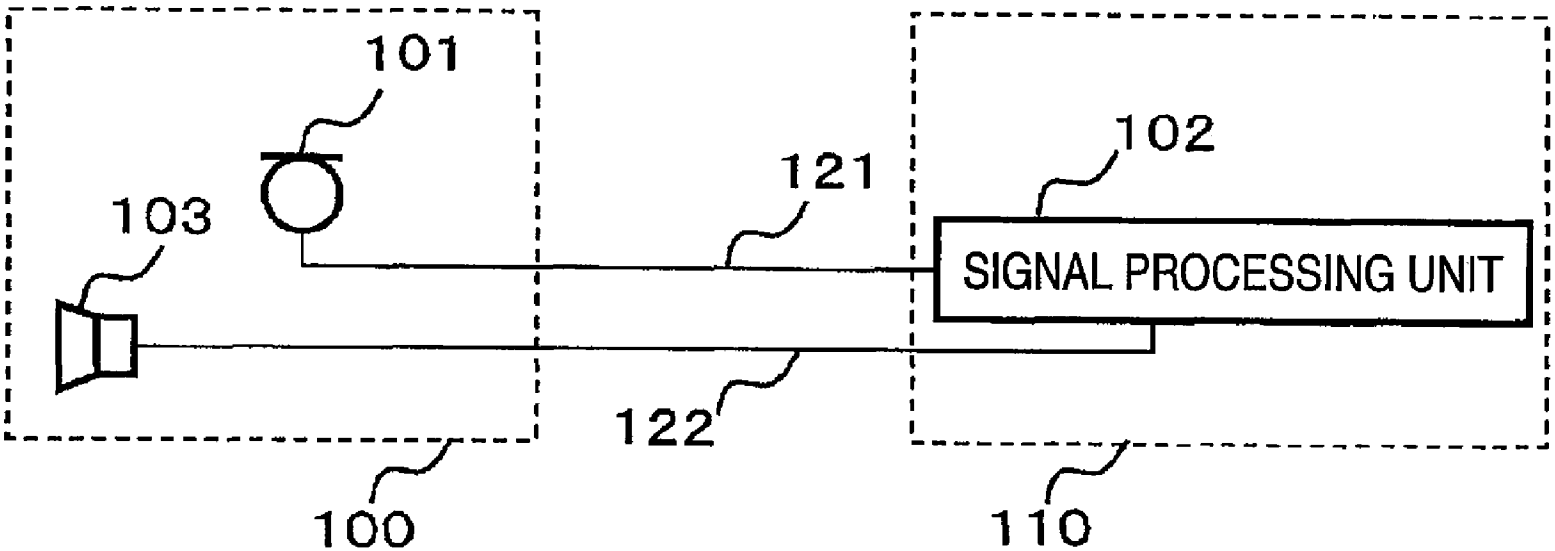
FIG. 1 It is a view showing an example functional configuration of a hearing aid of a first embodiment of the present invention.

A drawing showing an example configuration of a hearing aid of a first embodiment of the present invention is provided in FIG. 1. The hearing aid of the present invention can be broadly divided into two constituent elements. One is an ear canal portion 100 that is disposed in at least either the inside of an ear canal or an entrance of the same when a behind-the-ear portion 110 to be described later is worn on an ear, and the other is the behind-the-ear portion 110 fitted to the ear so as to stay at an upper portion of the pinna and a position behind the pinna. The entrance of the ear canal refers to a portion that lies in an extension of the ear canal and closer to an eardrum than to a plane defined by the helix, the tragus, and the earlobe.

The ear canal portion 100 is configured to include a microphone 101 and a receiver 103. The behind-the-ear portion 110 includes signal processing unit 102. As electrical connections, the microphone 101 and the signal processing unit 102 are connected by an electric wire 121, and the signal processing unit 102 and the receiver 103 are connected by an electric wire 122. The electric wire 121 and the electric wire 122 are examples of signal lines along which various kinds of information are transmitted.

Next, the process flow performed by the hearing aid of the present embodiment will be described by reference to FIG. 1. First, the microphone 101 converts an input sound into an input audio signal. The thus-converted input audio signal is transmitted to the signal processing unit 102. The signal processing unit 102 processes the input audio signal so as to generate an output audio signal. The thus-generated output audio signal is transmitted to the receiver 103, and the receiver 103 converts the output audio signal into an output sound so as to reproduce an output sound for an hearing aid wearer.

The process details of the signal processing unit 102 are auxiliary explained. The process of the signal processing unit 102 differs on whether the hearing aid is an analogue hearing aid or a digital hearing aid.

In the case of an analogue hearing aid, the signal processing unit 102 amplifies the input audio signal based on a hearing level of the hearing aid wearer and thereby generates an output audio signal. Further, in order to protect audibility of the hearing aid wearer, the maximum acoustic gain is limited.

While in the case of a digital hearing aid, the signal processing unit 102 becomes possible to analyze and synthesize frequencies. Therefore, a nonlinear compression process which changes the amplification factor for each frequency signal is performed depending on a pattern of an audiogram of the hearing aid wearer. The audiogram is a special graph for evaluating an auditory organ. The degree, type, and progress of hearing-impaired can be expressed by the audiogram. The signal processing unit 102 performs a howling suppression process for suppressing a howling sound that is likely to arise when the hearing aid is worn, a directivity synthesis process for enhancing a sound whose source located in a forward direction, and a wind noise suppression process for suppressing grating wind noise.

Although examples of the process detail of the signal processing unit 102 are described, the processes are not limited to these examples.

Figure 2A:
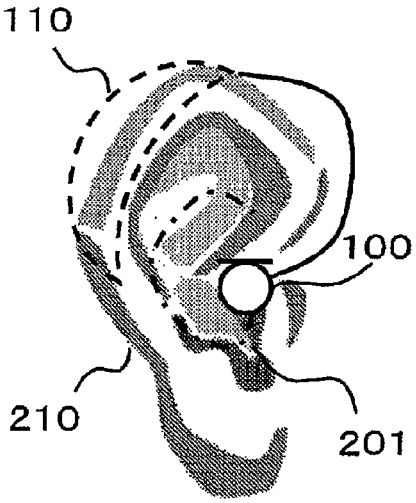
FIG. 2 (*a*) It is a schematic view of the hearing aid of the first embodiment of the present invention (a front view of the hearing aid with respect to a pinna), (b) it is a schematic view of the hearing aid of the first embodiment of the present invention (a vertical cross-sectional view of a portion of the hearing aid with respect to an ear canal area); and (c) it is a schematic view of the hearing aid of the first embodiment of the present invention (a horizontal cross-sectional view of the hearing aid with respect to the ear canal area)
Figure 2B:
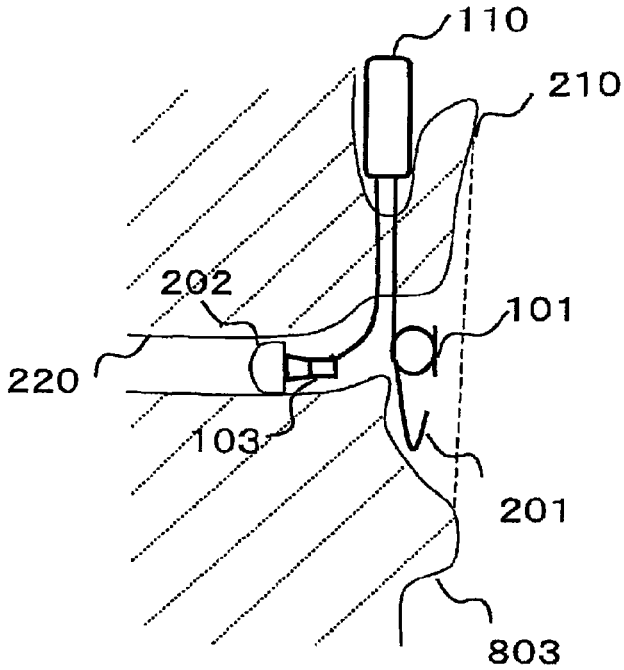
Figure 2C:
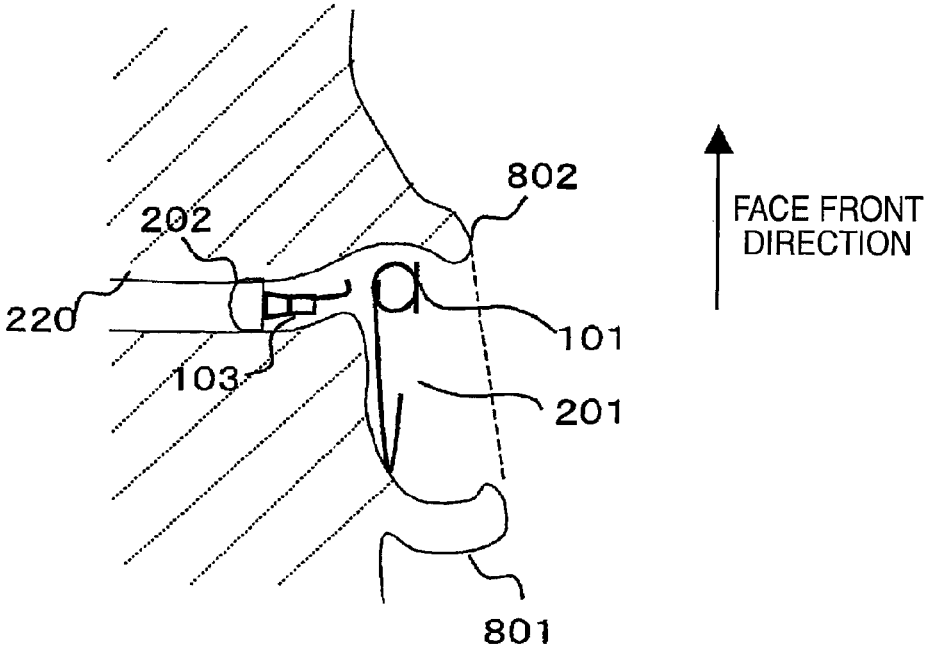

FIG. 2(*a*) is a schematic view showing an example hearing aid of the first embodiment of the present invention and provides a front view of the hearing aid with respect to a pinna on which the hearing aid is worn. In FIG. 2(*a*), the behind-the-ear portion 110 is fitted to an upper portion of the pinna 210 and a location behind the pinna 210. Further, the ear canal portion 100 is disposed in a dent at the center of the pinna so as to assume a circular arc. Therefore, the hearing aid is unobtrusive from the outside and does not impair an aesthetic property of the hearing aid wearer.

FIG. 2(*b*) is a schematic view of the hearing aid of the first embodiment of the present invention and provides a vertical cross-sectional view of the hearing aid with respect to the ear canal area while the hearing aid is worn on the ear. FIG. 2(*c*) is a schematic view of the hearing aid of the first embodiment of the present invention and provides a horizontal cross-sectional view of the hearing aid with respect to the ear canal area while the hearing aid is worn on the ear. In FIG. 2(*b*), the behind-the-ear portion 110 is put on the upper portion of the pinna 210 and at the position behind the pinna 210 in the same manner as shown in FIG. 2(*a*). In FIGS. 2(*b*) and 2(*c*), the ear canal portion 100 is provided at the entrance and inside of the ear canal 220. Specifically, the microphone 101 of the ear canal portion 100 is disposed at the entrance of the ear canal, and the receiver 103 is placed in the ear canal. The ear canal portion 100 is connected to the behind-the-ear portion 110 by the electric wire 121, and the behind-the-ear portion 110 is connected to the receiver 103 by the electric wire 122.

In order to hold the microphone 101 in the entrance of the ear canal, a projection 201 sticking out from a sheath of the electric wire 121 is provided. The projection 201 may also be positioned in a dent of the pinna 210 so as to assume a circular arc shape. The projection 201 assumes a columnar shape having; for instance, a diameter of the projection 201 about 1 mm and a length is ranging from about 20 mm to 40 mm, and is disposed in the dent of the ear so as to assume a circular arc shape. Nylon, a nylon-based elastomer, or the like, is used as a raw material of the projection 201. Since the hearing aid is fixed to a predetermined position by contacting the dent of the ear by the projection 201, a desired input characteristic of the microphone 101 is acquired. Even when the head of the hearing aid wearer has moved, an impact sound resulting from the microphone 101 contacting the pinna can be lessened.

In the hearing aid of the present embodiment, an ear chip 202 is provided at an extremity of the receiver 103. The ear chip is present in order to hold the receiver 103 in the ear canal 220. Since earwax buildup in the ear canal 220, it is useful to attach an ear wax prevention film on a chip portion of the ear chip where sound holes are provided. If the ear chip 202 is removable from the receiver 103 and the hearing aid wearer can replace or clean the ear chip 202 when the ear chip 202 is stained by, the ear chip is more useful.

In the hearing aid of the present embodiment, the electric wire 121 that connects the microphone 101 to the signal processing unit 102 may also be a twisted pair wire. Influence of a noise stemming from electromagnetic induction caused by an electric current change in the electric wire 121 can thereby be diminished. The electric wire 121 may also be a shielded wire. Influence of a noise stemming from external electromagnetic induction other than the electromagnetic induction developed in the electric wire 121 can be diminished. In the hearing aid of the present embodiment, since the microphone 101 is included in the ear canal portion 100, the wire 121 is long as compared with the case where the microphone 101 is included in the behind-the-ear portion 110 as the related behind-the-ear hearing aid. However, by using above explained twisted pair wire or shielded wire, noises tend not to be added even if the input sound signal is transmitted through the wire 121.

Here, the sound affected by a change in frequency characteristic originated from the pinna is the input sound as the microphone 101 is disposed in the entrance of the ear canal. The change in frequency characteristic is not changed up to about 3 kHz (mainly vowels) but changed in higher frequency than it (mainly consonants). By using a twisted pair wire and a shielded wire as the electric wire 121, the change in frequency characteristic by the canal is accurately transmitted from the microphone 101 to the signal processing unit 102, and the noise added to the signal line through which a signal is transmitted is lessened so that an SN ratio (a signal-to-noise ratio) can be improved. Moreover, although the consonants have small signal energy and high frequency as compared with the vowels, by using the twisted pair wire and the shielded wire as the wire 121 so as to improve the SN ratio, when the hearing aid wearer listens to a conversation sound, the consonants is easy to listen.

The configuration of the electric wire 121 such as that mentioned above, is also applicable to the electric wire 122 that connects the signal processing unit 102 to the receiver 103. Specifically, the influence of a noise stemming from an electromagnetic noise developed in the electric wire can be diminished by using a twisted pair wire for the electric wire 122. Moreover, the influence of the noise stemming from the electromagnetic induction developed outside can be lessened by using the shielded wire for the electric wire 122.

Although unillustrated in FIG. 2, the microphone 101 placed in the ear canal portion 100 and the receiver 103 may also be formed into a single unit by molding a shell or a mold. It becomes thereby easy for the hearing aid wearer to handle the ear canal portion 100.

When the microphone 101 and the receiver 103 are assembled into the single unit, a soundproof material may also be interposed between the microphone 101 and the receiver 103. As the sound proof material, with a view to preventing leakage of the sound output from the receiver 103 from the ear canal 220, a hemispherical or mushroom-shaped ear chip formed from silicone rubber is provided.

Although the silicone rubber is a soft material, the silicone rubber may be disposed as the soundproof material by molding an ear mold from an acryl which is a hard material in conformity with the ear shape of the hearing aid wearer in order to enhance the sound proof effect. By disposing the soundproof material, the frequency of occurrence of howling originated from the acoustic coupling between the microphone 101 and the receiver 103 can be reduced.

Also, an MEMS microphone may be used as the microphone 101. The MEMS (Micro Electro Mechanical System) is a small system which acts with high precision manufactured by a three-dimensional microprocessing technique based on a semiconductor technology. The MEMS microphone is a silicon microphone utilizing the MEMS technology and a condenser type is going a main stream. Recently, a MEMS microphone of 1 mm square in size has been developed. Accordingly, as compared with a case where an electret capacitor microphone is used as the microphone 101, a microphone does not become obtrusive; namely, an aesthetic property can be improved.

Figure 7:
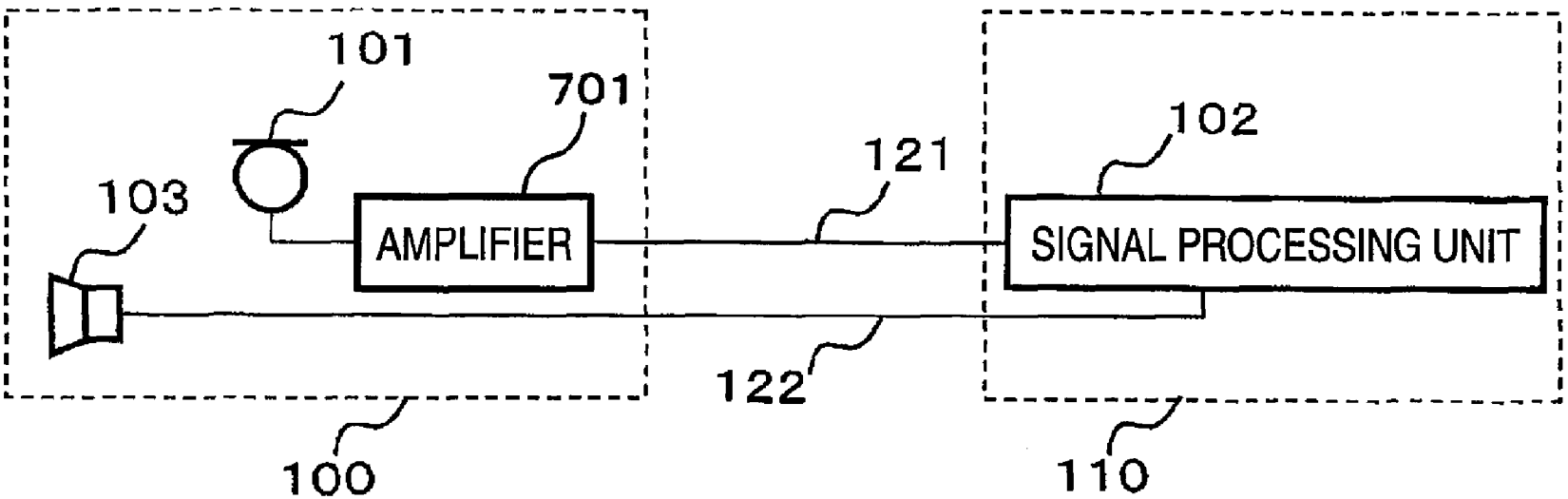
FIG. 7 It is a view showing an example functional configuration of the hearing aid of the first embodiment of the present invention.
Figure 8:
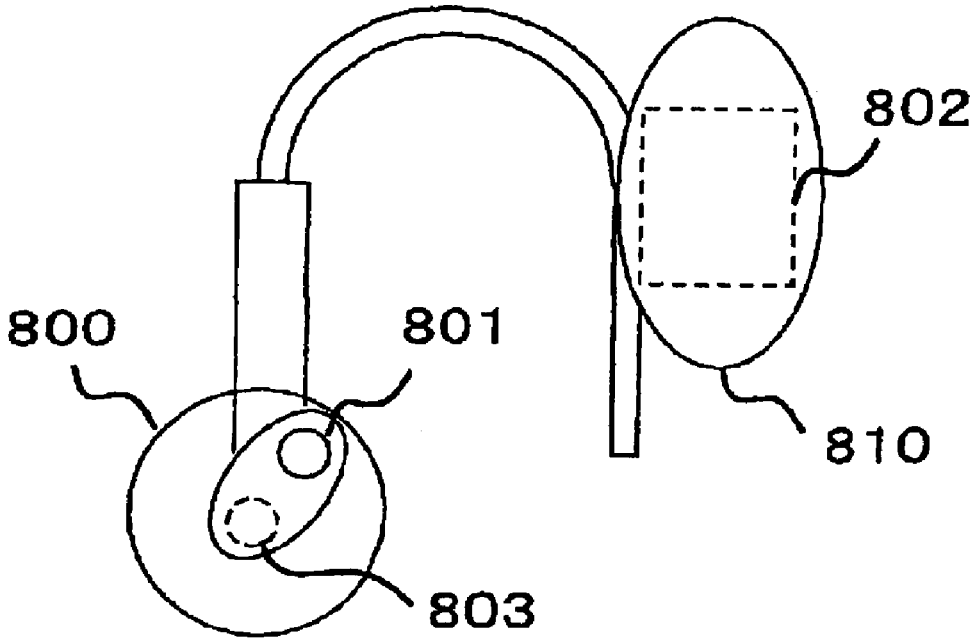
FIG. 8 It is a schematic view of a related-art hearing aid.

FIG. 7 shows an example functional configuration of the hearing aid of the first embodiment of the present invention. FIG. 7 shows a configuration in which an amplifier 701 is added to an electric wire 121 connecting the microphone 101 to the signal processing unit 102. According to the configuration, the first input signal converted by the microphone 101 can be amplified by the amplifier 701 to generate a second input signal. The signal processing unit 102 can generate an output signal based on the second input signal. As compared with the related behind-the-ear hearing aid, since the microphone 101 is disposed in the ear canal portion 100, the length of the electric wire 121 is extended and a voltage drop in the electric wire 121 increases. It is supposed that the time jitter of the electric current flowing through the electric wire 122 of the receiver 103 causes the electromagnetic induction in the wire and the electromotive force develops in the electric wire 121 connected to the microphone 101. Against the voltage drop due to the extension of the wire and the additive noise due to the electromagnetic induction, it is possible to transmit the second input signal with a wave form which is close to that of the first input signal by adding the amplifier 701, namely the microphone amplifier, as a constituent element.

Additionally, in the case where the MEMS microphone is used as the microphone 101, as compared with the case where the electret condenser microphone is used, there is a tendency to have a lower output voltage level for the same input sound. Therefore, in the case where the MEMS microphone is used as the microphone 101, the SN ratio of the MEMS microphone is improved by adding the amplifier 701 as a constituent element.

As mentioned above, the behind-the-ear hearing aid of the present embodiment is a behind-the-ear hearing aid used while worn on the ear of the human body. The hearing aid includes the microphone 101 that collects an ambient sound and converts the thus-collected sound into an input signal, the main unit (behind-the-ear portion 110) which is wearable on the ear and includes at least the signal processing unit 102 generating an output signal based on the input signal, and the receiver 103 which reproduces the output sound based on the output signal. Also, in the case where the main unit is worn on the ear, the microphone 101 is disposed in the entrance of the ear canal that lies in an extension of the ear canal 220 and that is closer to the drum membrane than to a plane defined by the helix 901, the tragus 902, and the earlobe 903. According to such a behind-the-ear hearing aid, the hearing aid wearer can easily estimate the sound source position in the front-back direction and the aesthetic property while the hearing aid is worn is enhanced. Moreover, it is possible to distance the microphone 101 from the receiver 103 and reduce the probability of occurrence of howling by disposing in the entrance of the ear canal that is closer to the drum membrane than to the plane defined by the helix 901, the tragus 902, and the earlobe 903, and also disposed in the concha 904.

Second Embodiment

Figure 3:
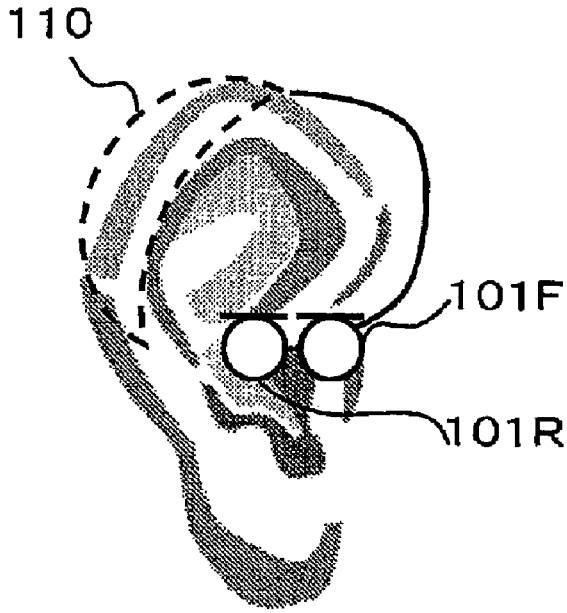
FIG. 3 It is a schematic view of an example hearing aid of a second embodiment of the present invention.
Figure 4:
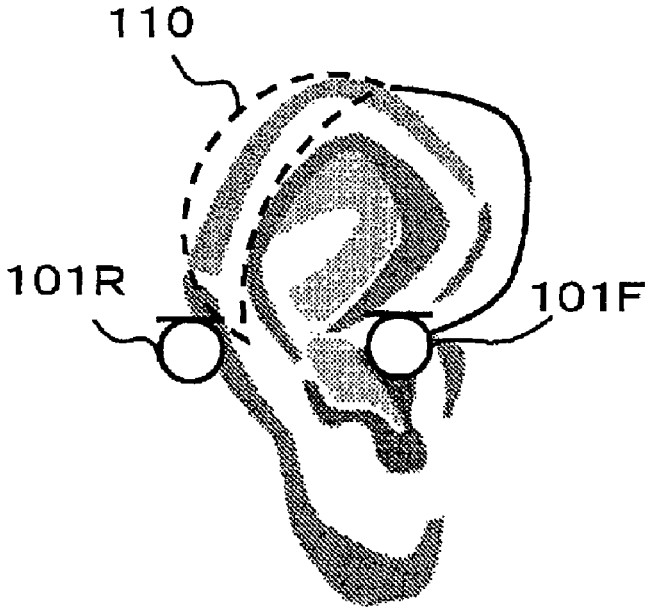
FIG. 4 It is a schematic view of an example hearing aid of the second embodiment of the present invention.

FIGS. 3 and 4 are schematic diagrams showing an example hearing aid of a second embodiment of the present invention and front views of the hearing aid with respect to the pinna to which the hearing aid is worn. In FIGS. 3 and 4, explanations for the elements that are the same as those shown in FIG. 2(*a*) are omitted; however, a new feature of the embodiment addresses to a plurality of microphones. Although two microphones are described in connection with FIGS. 3 and 4, the number of microphones is not limited to two.

In FIG. 3, when the behind-the-ear portion 110 is fitted to the ear, the two microphones are arranged in the entrance of the ear canal. In FIG. 3, what is disposed at a forward position with respect to the front of a face is a microphone 101F, and what is disposed at a rearward position with respect to the front of a face is a microphone 101R. What is important is that the microphone 101F and the microphone 101R are arranged front and back with respect to the front of the face. This is intended that the signal processing unit 102 performs directivity synthesis process to be described later and becomes useful when the hearing aid wearer enhances an audio signal coming from the front.

In FIG. 4, when the behind-the-ear portion 110 is fitted to the ear, at least one of a plurality of microphones is arranged in the entrance of the ear canal, and at least another microphone is arranged in a rear portion of the pinna. In FIG. 4, what is disposed in the entrance of the ear canal (at a forward position) is assumed to be the microphone 101F, and what is disposed in the rear portion of the pinna (at a rear position) is assumed to be the microphone 101R. What is important here is that the microphone 101F and the microphone 101R are spaced apart from each other by a certain distance. In relation to the positions where the microphones are disposed, the microphone 101F and the microphone 101R are arranged at front and back positions with respect to the front of the face.

Figure 5:
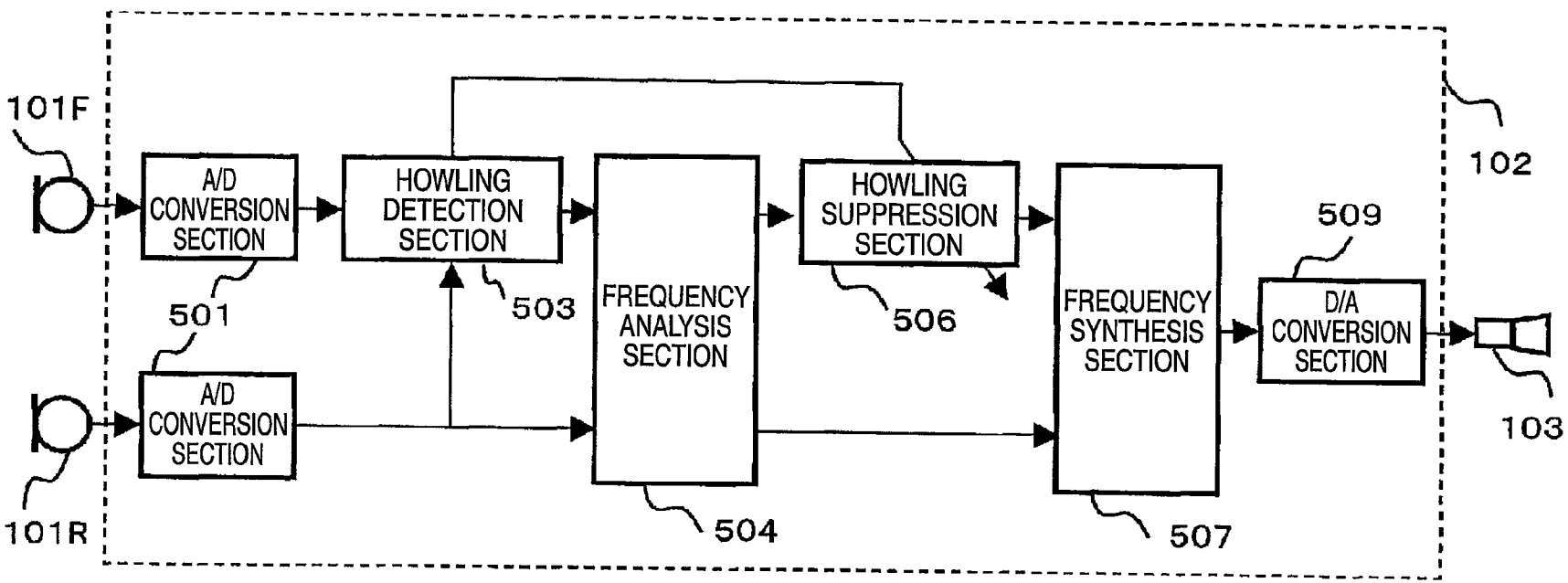
FIG. 5 It is a view showing an example functional configuration of the hearing aid of the second embodiment of the present invention (howling suppression processing).

FIG. 5 is a block diagram showing an exampled functional configuration of the hearing aid of the second embodiment of the present invention. The hearing aid of the present embodiment is configured to include the microphones 101F and 101R, the signal processing unit 102, and the receiver 103. The signal processing unit 102 has an A/D conversion section 501, a howling detection section 503, a frequency analysis section 504, a howling suppression section 506, a frequency synthesis section 507, and a D/A conversion section 509.

The process flow to be performed by the hearing aid of the present embodiment is now described by reference to FIG. 5.

The forward microphone 101F and the rearward microphone 101R convert input sound into an input analogue audio signal. The signal processing unit 102 processes the input analogue audio signal, to thus generate an output analogue audio signal. The receiver 103 converts the output analogue audio signal into an output sound, and the output sound is reproduced for the hearing aid wearer.

The signal processing unit 102 in FIG. 5 will now be described in detail.

The A/D conversion section 501 converts the input analogue audio signal into an input digital audio signal. The input digital audio signal converted by the A/D conversion section 501 is input to the howling detection section 503. Subsequently, the frequency analysis section 504 converts the input digital audio signal from a time domain signal into a frequency domain signal. Since the howling sound occurs in a specific frequency range, for example 3 kHz, it is effective to suppress the signal about the 3 kHz frequency range in order to suppress the howling. The howling suppression section 506 performs the howling suppression process based on the detection result of the howling detection section 503. The frequency synthesis section 507 converts the signal of the frequency range which is howling suppressing processed into a signal of time domain. The signal converted into time domain is the output digital signal and the D/A conversion section 509 converts the output digital signal into the output analogue signal.

The howling suppression process is now described. A howling arises when a feedback circuit is formed while the microphone 101 remains in close proximity to the receiver 103. In the hearing aid shown in FIGS. 3 and 4, the microphone 101F disposed in the entrance of the ear canal and the receiver 103 disposed in the ear canal are in close proximity to each other; hence, the probability of occurrence of howling becomes high. In the meantime, since the microphone 101R is disposed; for instance, behind the rear of the pinna, the probability of occurrence of howling becomes lower as compared with the probability of occurrence of howling in the microphone 101F. In the present embodiment, howling is detected (a determination is made as to whether or not howling has occurred) by utilization of a difference in probability of occurrence of howling attributable to a difference in positions where the microphones are disposed.

The howling detection section 503 is subsequently described in detail. The howling detection section 503 compares the intensity of an audio signal from the microphone 101F with the intensity of an audio signal from the microphone 101R. In order to compare the intensity of the signal from the microphone 101F with the intensity of the signal from the microphone 101R at this time, signals can be compared with each other in terms of intensity without depending on symbols of audio signal values by utilization of an absolute value or a squared value. It is possible to absorb the influence of instantaneous change in the audio signal on the comparison by smoothing an audio signal in a time direction in order to compute signal intensity of a computed absolute value or squared value. Therefore, a stable howling detecting operation can be performed. When the computed signals are compared with each other in terms of intensity and when a resultant difference exceeds a predetermined threshold value, howling sound is determined to have occurred, and a howling detection flag is computed. The howling suppression section 506 performs processing for suppressing howling sound by reference to the howling detection flag. Through howling suppression processing, the howling suppression section 506 reduces signal intensity with regard to a specific frequency range (e.g., a frequency band where howling is detected) of an input signal.

Figure 6:
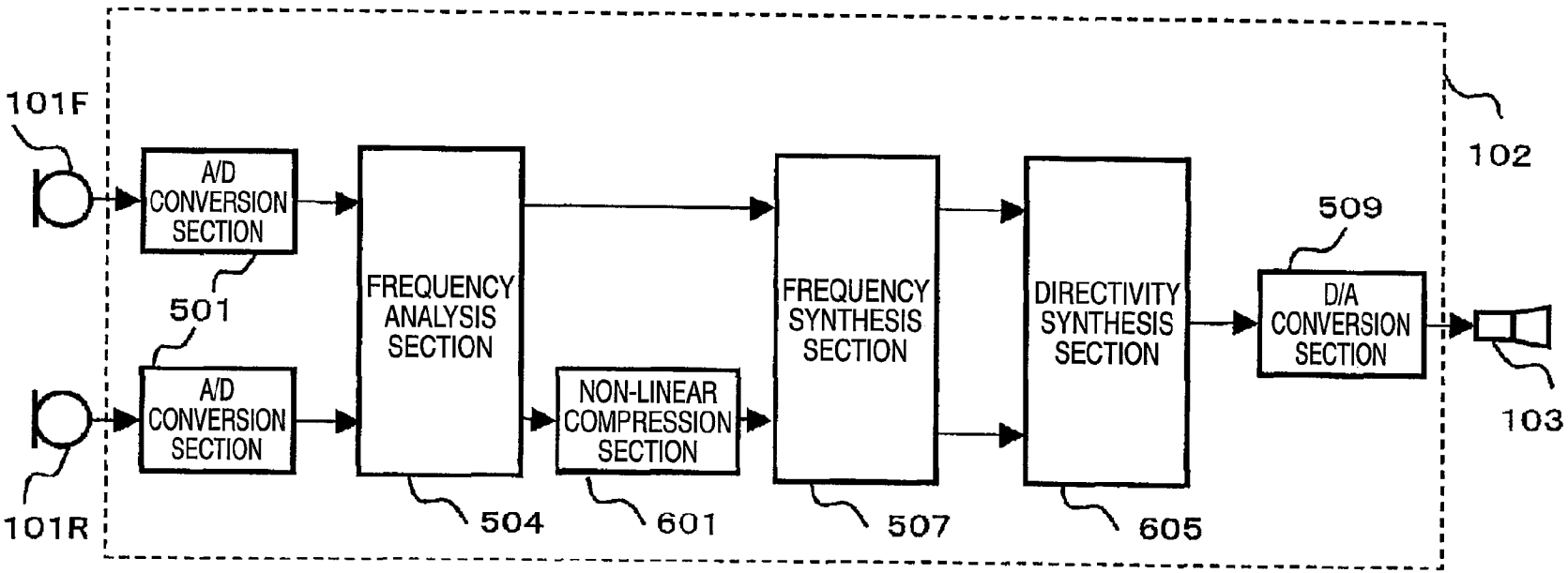
FIG. 6 It is a view showing an example functional configuration of the hearing aid of the second embodiment of the present invention (directivity synthesis processing).

FIG. 6 is a block diagram showing an example functional configuration of the hearing aid of the second embodiment of the present invention. Directivity synthesis processing is herein chiefly described. In the hearing aid of the present embodiment, when the behind-the-ear portion 110 is fitted to the ear, the microphone 101F disposed in the entrance of the ear canal and the microphone 101R disposed in; for instance, the rear of the pinna, differ from each other in terms of a frequency characteristic because of a difference in transmission function attributable to the shape of the pinna. Therefore, processing for correcting the difference in frequency characteristic is performed during directivity synthesis processing. Explanations are provided here for a case where the hearing aid is equipped with two microphones as a plurality of microphones. However, the number of the microphones is not limited to this number.

In FIG. 6, the microphones 101F and 101R, the A/D conversion section 501, the D/A conversion section 509, and the receiver 102 are the same as those shown in FIG. 5; hence, their explanations are omitted. A section in the signal processing unit 103 that handles a digital audio signal will be described.

The frequency analysis section 504 converts an input digital audio signal, which is output from the A/D conversion section 501, from a time domain signal into a frequency domain signal. Subsequently, a nonlinear compression section 601 compresses and amplifiers the frequency domain signal; for instance, in such a way that a signal from the microphone 101R disposed in the rear of the pinna becomes equal to a signal from the microphone 101F in terms of a frequency characteristic. For example, since the microphone 101F is disposed in the entrance of the ear canal that is the center of the pinna, the microphone experiences a frequency characteristic of the pinna, whilst the microphone 101R does not undergo the influence. Further, since the microphone 101R is disposed; for instance, behind the rear of the pinna, the frequency characteristic of the microphone 101R differs from the frequency characteristic of the microphone 101F. The nonlinear compression section 601 corrects the frequency characteristic difference.

The frequency synthesis section 507 converts the signal corrected by the nonlinear compression section 601 from a frequency domain signal into a time domain signal.

The directivity synthesis section 605 subjects the time domain signal to directivity synthesis processing. Through directivity synthesis processing, there is performed processing for converting a signal input by way of a high pass filter or a phase delay filter and computing a signal pertaining to a difference between one signal and the other signal. A method for mounting a hearing aid includes a stationary array method by means of which unchanged directional sensitivity is achieved at all times and an adaptive array method by means of which the hearing aid is made adaptive to an ambient environment in such a way as to minimize a noise coming from a specific direction. A directional pattern of the adaptive array changes according to the origin of the noise. In the case of an adaptive array, a signal from the microphone 101R is subtracted from the signal from the microphone 101F in consideration of a predetermined delay time, whereby directivity synthesis processing is performed. At this time, the predetermined delay time is made variable with allowance for influence on directivity in the direction of the front of the face. Sensitivity to sounds from directions of the principal noise sources is made as closely to zero as possible, so that sensitivity to sounds from the front of the face can be maintained at a high level. Thus, the directivity synthesis section 605 generates, from the signal from the microphone 101F and the signal from the microphone 101R, an output signal exhibiting directivity toward a predetermined direction. A signal in a desired direction is enhanced by means of directivity synthesis processing, so that an advantage of the ability to control directivity of incoming sounds is yielded.

Although the present invention has been described in detail and by reference to the specific embodiments, it is manifest to those skilled in the art that the present invention can be subjected to various alterations and modifications without departing form the spirit and scope of the present invention.

The present patent application is based on Japanese patent application No. 2008-138198 filed on May 27, 2008 in Japan, contents of which are incorporated herein for reference.

INDUSTRIAL APPLICABILITY

As mentioned above, the hearing aid of the present invention is a behind-the-ear-type hearing aid, and a microphone is disposed in an entrance of an ear canal, whereby the incoming sound from the sound source is converted into input sound reflecting a frequency characteristic of the pinna. As a consequence, there is yielded an advantage of the person who wears the behind-the-ear hearing aid becoming easy to estimate the position of the sound source in a vertical direction; particularly, a front-back direction, as well as in a horizontal direction. Thus, the hearing aid is useful as a behind-the-ear hearing aid, or the like, exhibiting high aesthetic property.

DESCRIPTIONS OF THE REFERENCE NUMERALS AND SYMBOLS

100 EAR CANAL PORTION
101 MICROPHONE
102 SIGNAL PROCESSING UNIT
103 RECEIVER
110 BEHIND-THE-EAR PORTION
101F (FRONT) MICROPHONE
101R (REAR) MICROPHONE
201 INVERTED SPINAL HOOK
202 EAR CHIP
210 PINNA
220 EAR CANAL
501 A/D CONVERSION SECTION
503 HOWLING DETECTION SECTION
504 FREQUENCY ANALYSIS SECTION
506 HOWLING SUPPRESSION SECTION
507 FREQUENCY SYNTHESIS SECTION
509 D/A CONVERSION SECTION
601 NONLINEAR COMPRESSION SECTION
605 DIRECTIVITY SYNTHESIS SECTION
701 AMPLIFIER
800 EAR FITTING

801 MICROPHONE
802 SIGNAL PROCESSING UNIT
803 RECEIVER
810 BEHIND-THE-EAR PORTION
901 HELIX
902 TRAGUS
903 EARLOBE
904 CONCHA

The invention claimed is:

1. A behind-the-ear hearing aid used while worn on an ear of a human body, comprising:

a microphone collecting an ambient sound and generating an input signal;

a main unit to be worn at the ear, which includes at least a signal processing unit generating an output signal based on the input signal; and a receiver reproducing an output sound based on the output signal, wherein the microphone and the receiver are provided as separate members, the microphone is configured to be disposed in an entrance of an ear canal and a concha, and the receiver is configured to be disposed in the ear canal when the main unit is worn at the ear, and a signal line connecting the microphone and the signal processing unit is a twisted pair wire or a shielded wire.

2. The behind-the-ear hearing aid according to claim 1, further comprising at least one projection projecting from a signal line connected to the microphone and the signal processing unit the at least one projection configured to hold the microphone in the entrance of the ear canal and the concha.

3. The behind-the-ear hearing aid according to claim 1, further comprising a soundproof material interposed between the microphone and the receiver when the main unit is worn at the ear.

4. The behind-the-ear hearing aid according to claim 1, further comprising a second microphone.

5. The behind-the-ear hearing aid according to claim 4, wherein the second microphone is disposed in a rear of a pinna when the main unit is worn at the ear.

6. The behind-the-ear hearing aid according to claim 5, wherein the signal processing unit compares intensity of the input signal from the microphone with intensity of the input signal from the second microphone, and judges howling based on a result of the comparison.

7. The behind-the-ear hearing aid according to claim 5, wherein the signal processing unit corrects frequency characteristics of the input signals based on a position where the microphone is disposed.

8. The behind-the-ear hearing aid according to claim 7, wherein the signal processing unit generates the output signal having directivity toward a predetermined direction based on the input signals from the microphones.

* * * * *